US007291816B2

(12) United States Patent
Chen

(10) Patent No.: US 7,291,816 B2
(45) Date of Patent: Nov. 6, 2007

(54) TRANSPARENT ELECTROTHERMAL BODY AND THE METHOD OF MAKING IT

(76) Inventor: Shu-Lien Chen, P.O. Box 55-124, Taichung (TW)

( * ) Notice: Subject to any disclaimer, the term of this patent is extended or adjusted under 35 U.S.C. 154(b) by 631 days.

(21) Appl. No.: 10/846,568

(22) Filed: May 17, 2004

(65) Prior Publication Data

US 2005/0252390 A1 Nov. 17, 2005

(51) Int. Cl.
*H05B 3/16* (2006.01)

(52) U.S. Cl. ..... 219/543; 219/203; 219/522; 219/541; 219/544; 219/213; 392/430; 392/435; 392/438; 428/630; 428/632; 428/633

(58) Field of Classification Search ..... 219/203, 219/522, 541, 543–4, 213; 392/430, 435, 392/438; 428/630, 632, 633
See application file for complete search history.

(56) References Cited

U.S. PATENT DOCUMENTS 6,723,958 B2 * 4/2004 Brandt et al. ..... 219/209
6,727,468 B1 * 4/2004 Nemeth ..... 219/209
6,822,208 B2 * 11/2004 Henze et al. ..... 219/740

* cited by examiner

*Primary Examiner*—Shawntina Fuqua

(57) ABSTRACT

A method for making a transparent electrothermal body includes: a) plating ITO (indium tin oxide) onto a surface of a transparent substrate to form an ITO film, and b) printing a conducting material onto a surface of the ITO film to form two connecting portions each electrically connected to the ITO film, thereby forming a transparent electrothermal body. Thus, the transparent electrothermal body includes a circuit made of ITO material having greater transparency to form a conducting film that allows passage of the electric current, thereby enhancing the transparency of the electrothermal body, and thereby increasing the versatility of the electrothermal body.

7 Claims, 3 Drawing Sheets

TRANSPARENT ELECTROTHERMAL BODY AND THE METHOD OF MAKING IT

BACKGROUND OF THE INVENTION

1. Field of the Invention

The present invention relates to a transparent electrothermal body, and more particularly to a method for making a transparent electrothermal body.

2. Description of the Related Art

A conventional electrothermal plate comprises an insulating plate, and a continuous winding circuit mounted on the insulating plate. The circuit is made of metallic material such as copper having a determined resistance, so that when the current passes through the circuit, a heat is produced by the resistance of the metallic material of the circuit. Thus, the conventional electrothermal plate may function as a heating source to provide a heat energy to evaporate the water and remove the moist or mist deposited on a surface, such as the rear windshield of a car.

However, the continuous metallic winding circuit mounted on the insulating plate of the conventional electrothermal plate is not transparent and easily affects the driver's viewing effect especially in the rainy day, thereby causing danger to the driver.

SUMMARY OF THE INVENTION

The present invention is to mitigate and/or obviate the disadvantage of the conventional electrothermal plate.

The primary objective of the present invention is to provide a transparent electrothermal body.

Another objective of the present invention is to provide a method for making a transparent electrothermal body.

A further objective of the present invention is to provide an electrothermal body including a circuit made of ITO material having greater transparency to form a conducting film that allows passage of the electric current, thereby enhancing the transparency of the electrothermal body, and thereby increasing the versatility of the electrothermal body.

In accordance with one embodiment of the present invention, there is provided a method for making a transparent electrothermal body, comprising:

a) plating ITO (indium tin oxide) onto a surface of a transparent substrate to form an ITO film; and b) printing a conducting material onto a surface of the ITO film to form two connecting portions each electrically connected to the ITO film, thereby forming a transparent electrothermal body.

In accordance with another embodiment of the present invention, there is provided a transparent electrothermal body, comprising:

a transparent substrate; and a circuit mounted on a first face of the substrate;

an adhesive mounted on a second face of the substrate; and a protective film mounted on a surface of the circuit.

Further benefits and advantages of the present invention will become apparent after a careful reading of the detailed description with appropriate reference to the accompanying drawings.

DETAILED DESCRIPTION OF THE INVENTION

Figure 1:
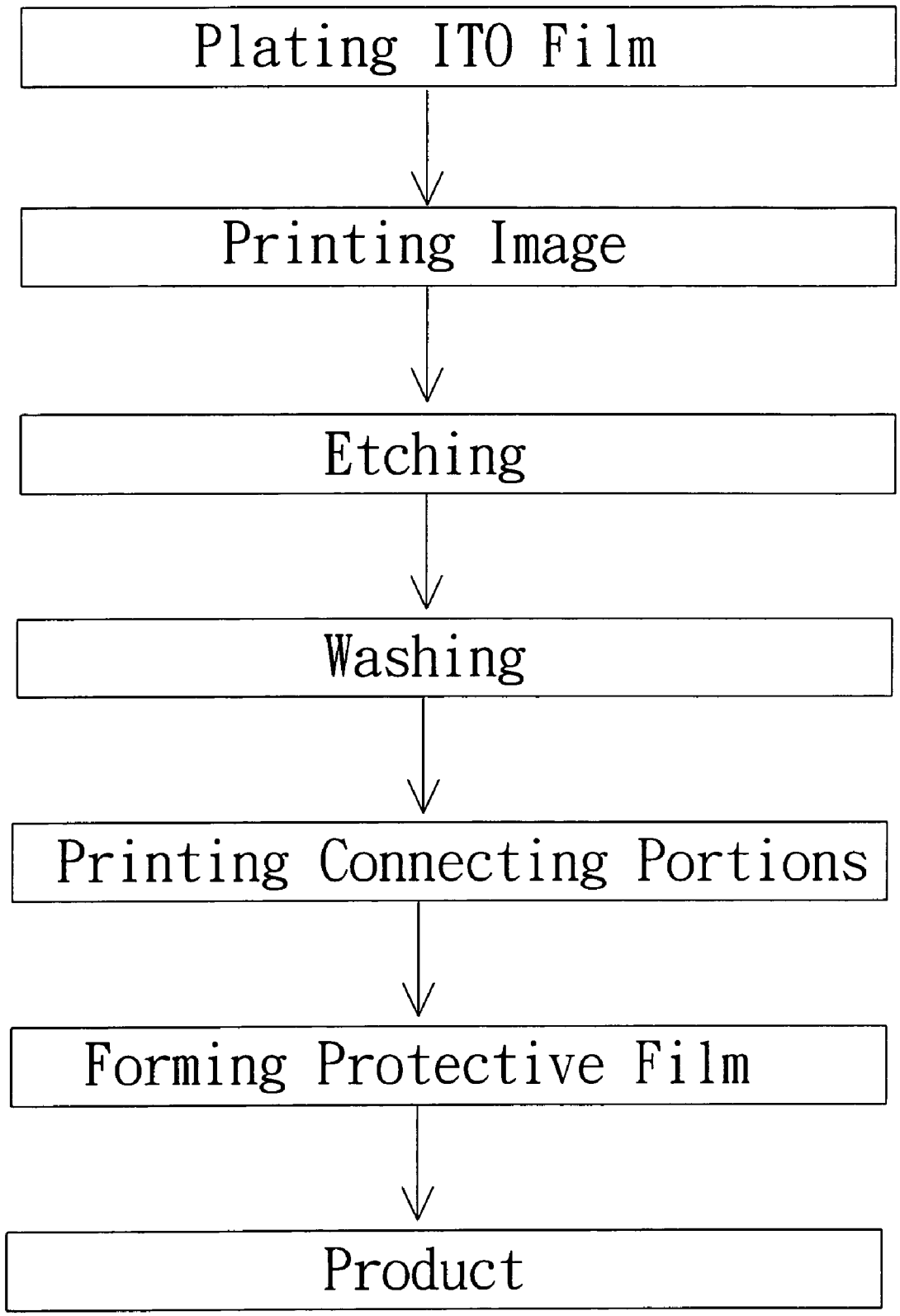
FIG. 1 is a flow chart of a method for making a transparent electrothermal body in accordance with the preferred embodiment of the present invention.

Referring to the drawings and initially to FIG. 1, a method for making a transparent electrothermal body in accordance with the preferred embodiment of the present invention comprises the steps of: plating ITO (indium tin oxide), printing image, etching, washing, printing connecting portions, and forming a protective film.

The plating ITO step includes plating ITO onto a surface of a transparent substrate in a sputtering manner to form an ITO film. Preferably, the substrate is made of glass or PE (polyester).

The printing image step includes printing oil ink onto a surface of the ITO film by a printing technology to form an image, so that the surface of the ITO film has a first portion formed with a shielded portion covered by the oil ink and a second portion formed with an exposed portion. In addition, the shielded portion of the ITO film satisfies the state of a predetermined circuit.

The etching step includes rinsing the ITO film by an acid solvent, so that the exposed portion of the ITO film is dissolved in the acid solvent and removed from the surface of the ITO film, and the shielded portion of the ITO film is protected by the oil ink and remains on the surface of the ITO film, thereby forming an ITO circuit that allows passage of the electric current.

The washing step includes washing the ITO circuit by a solvent to remove the printing oil ink from a surface of the ITO circuit.

The printing connecting portions step includes printing a conducting material onto the surface of the ITO circuit by a printing technology to form two connecting portions each located at one of two ends of the ITO circuit and each electrically connected to the ITO circuit. Preferably, the conducting material is made of copper.

The forming a protective film step includes coating an insulating material onto the surface of the substrate to form a protective film on the surface of the ITO circuit, thereby forming the product of a transparent electrothermal body. Preferably, the insulating material is made of resin.

Figure 2:
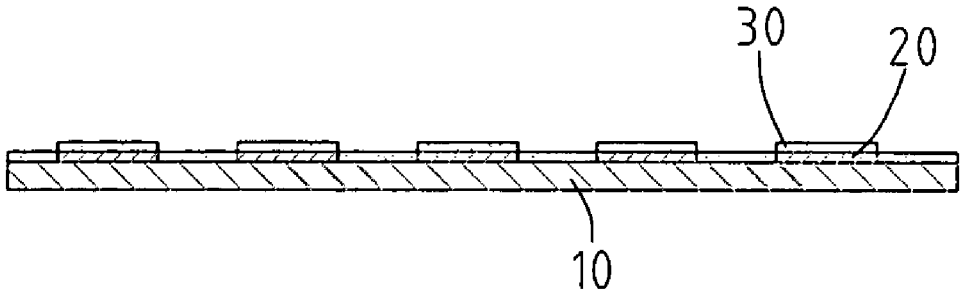
FIG. 2 is a plan cross-sectional view of a transparent electrothermal body in accordance with the preferred embodiment of the present invention.

As shown in FIG. 2, the transparent electrothermal body comprises a transparent substrate 10, a circuit 20 mounted on the substrate 10, and a protective film 30 mounted on the surface of the circuit 20. Preferably, the substrate 10 is made of glass or PE (polyester). The circuit 20 is made of ITO (indium tin oxide) and sandwiched between the substrate 10 and the protective film 30. In addition, the circuit 20 is a resistance circuit arranged in a winding manner and has two ends each electrically connected a conducting wire, so that the current passes through the circuit 20 to produce heat. Thus, when the substrate 10 is misted, the current passes through the circuit 20 to produce heat to remove the mist from the substrate 10.

Accordingly, the electrothermal body includes a circuit made of ITO having greater transparency to form a conducting film that allows passage of the electric current, thereby enhancing transparency of the electrothermal body, and thereby increasing the versatility of the electrothermal body.

Figure 3:
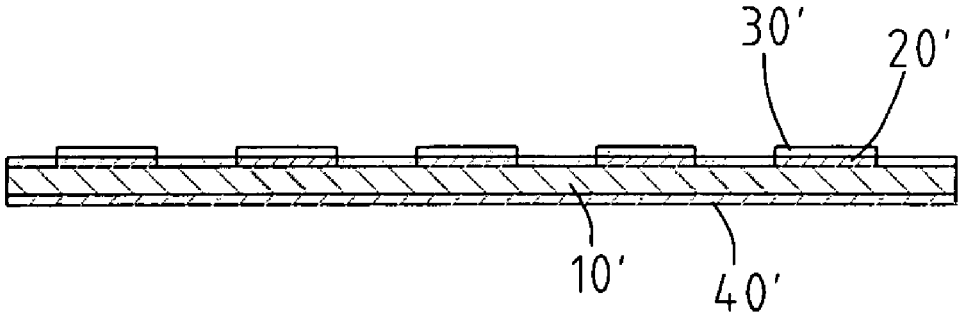
FIG. 3 is a plan cross-sectional view of a transparent electrothermal body in accordance with another embodiment of the present invention.

As shown in FIG. 3, the transparent electrothermal body comprises a transparent substrate 10', a circuit 20' mounted on a first face of the substrate 10', a protective film 30' mounted on the surface of the circuit 20', and an adhesive 40' mounted on a second face of the substrate 10'. In such a manner, by provision of the adhesive 40', the electrothermal body is bonded on a helmet or the windshield of a car, so that the electrothermal body can be used to achieve the anti-mist effect and has a greater transparency.

Figure 4:
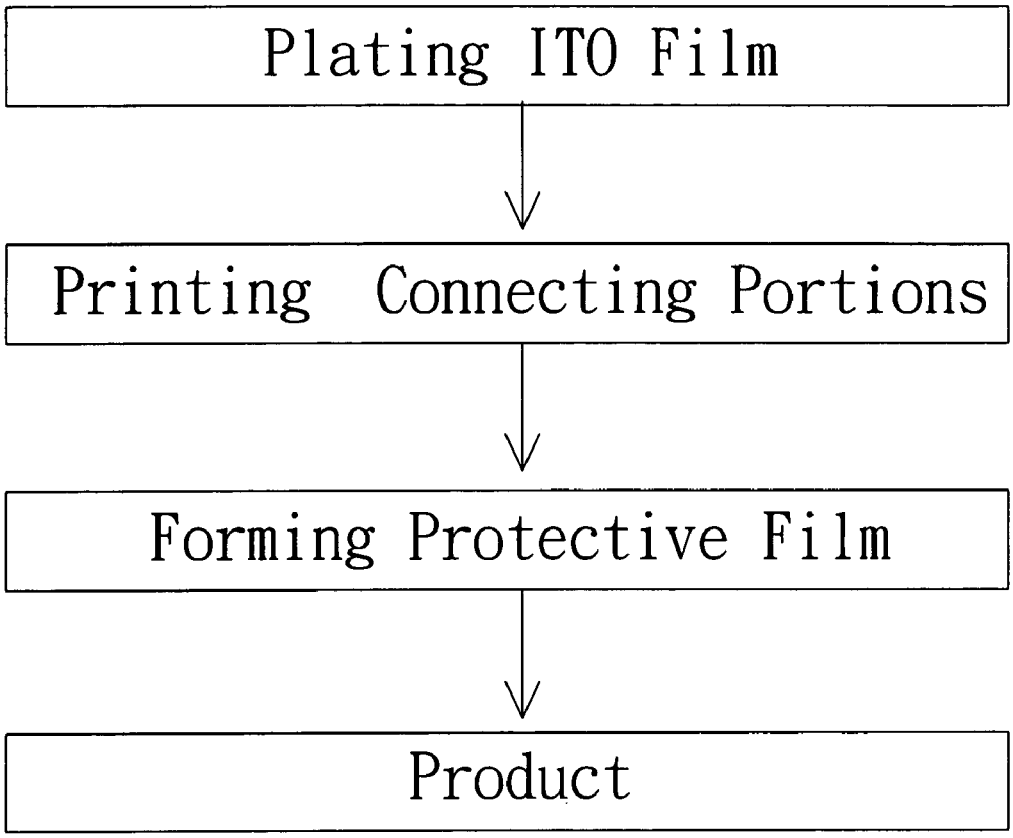
FIG. 4 is a flow chart of a method for making a transparent electrothermal body in accordance with another embodiment of the present invention.

Referring to FIG. 4, a method for making a transparent electrothermal body in accordance with another embodiment of the present invention comprises the steps of: plating ITO (indium tin oxide), printing connecting portions, and forming a protective film.

The plating ITO step includes plating ITO onto a surface of a transparent substrate in a sputtering manner to form an ITO film. Preferably, the substrate is made of glass or PE (polyester).

The printing connecting portions step includes printing a conducting material onto a surface of the ITO film by a printing technology to form two parallel elongated connecting portions each electrically connected to the ITO film. Preferably, the conducting material is made of copper.

The forming a protective film step includes coating an insulating material onto the surface of the substrate to form a protective film on the surface of the ITO film, thereby forming the product of a transparent electrothermal body. Preferably, the insulating material is made of resin.

Figure 5:
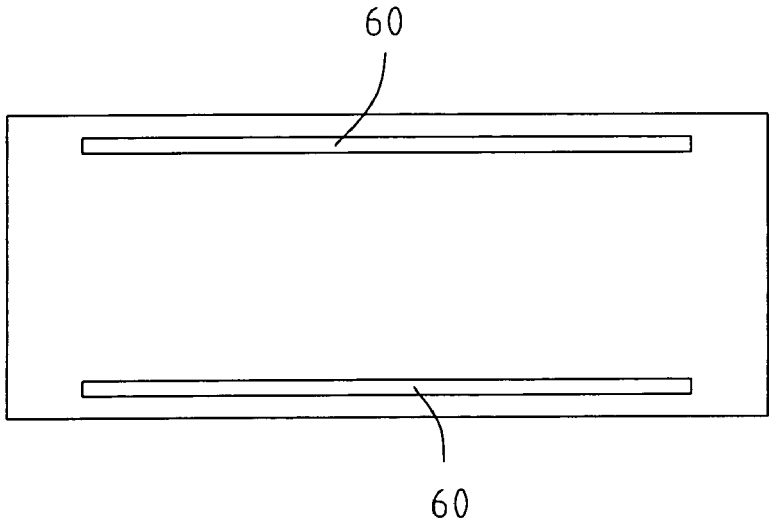
FIG. 5 is a top plan view of a transparent electrothermal body in accordance with another embodiment of the present invention.

As shown in FIG. 5, the two connecting portions of the ITO film are parallel with each other and are disposed in a linear manner. Thus, the ITO film forms multiple parallel circuits to allow passage of the current to produce the heat.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A method for making a transparent electrothermal body, comprising:

a) plating ITO (indium tin oxide) onto a surface of a transparent substrate to form an ITO film; and b) printing a conducting material onto a surface of the ITO film to form two connecting portions each electrically connected to the ITO film, thereby forming a transparent electrothermal body.

2. The method in accordance with claim 1, after the step a) further comprising step a1): printing oil ink onto the surface of the ITO film by a printing technology to form an image, so that the surface of the ITO film has a first portion formed with a shielded portion covered by the oil ink and a second portion formed with an exposed portion.

3. The method in accordance with claim 2, after the step a1) further comprising step a2): rinsing the ITO film by an acid solvent, so that the exposed portion of the ITO film is dissolved in the acid solvent and removed from the surface of the ITO film, and the shielded portion of the ITO film is protected by the oil ink and remains on the surface of the ITO film, thereby forming an ITO circuit that allows passage of an electric current.

4. The method in accordance with claim 3, after the step a2) further comprising step a3): washing the ITO circuit by a solvent to remove the printing oil ink from a surface of the ITO circuit.

5. The method in accordance with claim 1, after the step b) further comprising step b1): coating an insulating material onto the surface of the substrate to form a protective film on the surface of the ITO film.

6. The method in accordance with claim 1, wherein the ITO is plated onto the surface of the transparent substrate in a sputtering manner.

7. The method in accordance with claim 1, wherein the conducting material is printed onto the surface of the ITO film by a printing technology.

* * * * *